US007461842B2

(12) United States Patent
Wu

(10) Patent No.: US 7,461,842 B2
(45) Date of Patent: Dec. 9, 2008

(54) INNOVATORY ROTARY-TABLE GAME MACHINE

(76) Inventor: Wei-Hsuan Wu, 3F, No. 61, Sec. 1, Chenggong Rd., Nangang District, Taipei City 115 (TW)

( * ) Notice: Subject to any disclaimer, the term of this patent is extended or adjusted under 35 U.S.C. 154(b) by 12 days.

(21) Appl. No.: 11/769,718

(22) Filed: Jun. 28, 2007

(65) Prior Publication Data

US 2008/0277869 A1 Nov. 13, 2008

(30) Foreign Application Priority Data

May 8, 2007 (TW) ..... 96207325 U

(51) Int. Cl.
*A63B 71/00* (2006.01)

(52) U.S. Cl. ..... 273/142 R; 273/141 R; 273/142 J; 273/142 H; 273/142 HA; 273/143 R; 273/138.1; 273/139; 273/141 A; 273/138.2; 273/142 B; 463/17; 463/20; 463/16

(58) Field of Classification Search ..... 273/142 R, 273/141 R, 143 B, 143 D, 143 C, 143 E, 273/142 A, 142 B, 142 C, 142 D, 142 F, 142 H, 273/142 J, 142 JA, 142 JC, 142 JD, 145 E, 273/138.1, 138.2, 114, 143 R; 463/17, 20; D21/374, 375

See application file for complete search history.

(56) References Cited

U.S. PATENT DOCUMENTS

| | | | | |
|---|---|---|---|---|
| 2,077,124 | A * | 4/1937 | Miller et al. | 273/142 HA |
| 5,096,196 | A * | 3/1992 | Gutknecht et al. | 273/142 HA |
| 5,184,821 | A * | 2/1993 | Korenek | 273/138.2 |
| D345,385 | S * | 3/1994 | Palatin | D21/374 |
| 6,234,478 | B1 * | 5/2001 | Smith | 273/141 R |
| 6,648,647 | B2 * | 11/2003 | Wood et al. | 434/174 |
| 6,705,611 | B2 * | 3/2004 | Kato | 273/143 R |
| 6,705,944 | B2 * | 3/2004 | Luciano | 463/20 |
| 6,827,646 | B2 * | 12/2004 | Adams | 463/20 |
| D512,464 | S * | 12/2005 | Karstens | D21/370 |
| 2003/0060263 | A1 * | 3/2003 | Pearce et al. | 463/17 |
| 2006/0038343 | A1 * | 2/2006 | Adams | 273/143 R |
| 2007/0218983 | A1 * | 9/2007 | Lombardo | 463/27 |

* cited by examiner

*Primary Examiner*—Dmitry Suhol
*Assistant Examiner*—Alexander Niconovich
(74) *Attorney, Agent, or Firm*—Ming Chow; Sinorica, LLC

(57) ABSTRACT

A rotary-table game machine composed mainly of a rotary-table device and an index device, the rotary-table device has a rotary table rotated by a first motor; the index device has three index pins arranged to space equiangularly and rotated by a second motor. When in operation, the first motor and the second motor make the rotary table rotate reversely against the index pins; and when in stopping rotation, the three index pins point three different division areas at the periphery of the rotary table. By providing a main control board and a sensing plate in the rotary table, a result is show on a display. Thereby the rotary-table game machine can provide variant ways of playing, the odds of winning are increased; and fun of playing can be increased too.

8 Claims, 4 Drawing Sheets

INNOVATORY ROTARY-TABLE GAME MACHINE

BACKGROUND OF THE INVENTION

1. Field of the Invention

The present invention relates to an innovatory rotary-table game machine, and especially to such a game machine having three index pins with its rotary table turning reversely to provide variant ways of playing.

2. Description of the Prior Art

Rotary-table game machines are much welcome game machines, they are necessary for large casinos. Conventional rotary-table game machines each has a rotary table having at its periphery division areas and having a fixed index pin on its top end. When the rotary table stops rotating, the index pin points a division area; a player shall guess the color or number of the division area to be pointed in advance for deciding his winning or losing.

By virtue that the conventional rotary-table game machine only has an index pin, in playing, only one color or number can be guessed, and the odds of winning are very small; when guessing wrong for many times, the player will lose his interest; and such a game machine really needs improvement.

SUMMARY OF THE INVENTION

In view of the defect that the conventional rotary-table game machine has few ways of playing, the present invention provides an innovatory rotary-table game machine having variant ways of playing.

The rotary-table game machine provided in the present invention is composed of a rotary-table device and an index device. The rotary-table device has a rotary table rotated by a first motor; the index device has three index pins arranged to space equiangularly and rotated by a second motor. When in operation, the first motor and the second motor make the rotary table rotate reversely against the index pins. When in stopping rotation, the three index pins point three different division areas at the periphery of the rotary table. By providing a main control board and a sensing plate in the rotary table, a result is shown on a display. Thereby the rotary-table game machine can provide variant ways of playing, the odds of winning are increased; and fun of playing can be increased too.

The rotary-table game machine provided in the present invention can have the division areas at the periphery of the rotary table colored with a plurality of completely different colors, multiples or figures as markings, thus a player can have variant ways of guessing, and interest of playing can be largely increased.

The present invention will be apparent in its characteristics and variant ways of playing after reading the detailed description of the preferred embodiment thereof in reference to the accompanying drawings.

DETAILED DESCRIPTION OF THE PREFERRED EMBODIMENT

Referring to FIGS. 1-4, the rotary-table game machine of the present invention is composed mainly of a rotary-table device 10, an index device 20 and a display 30.

Figure 1:
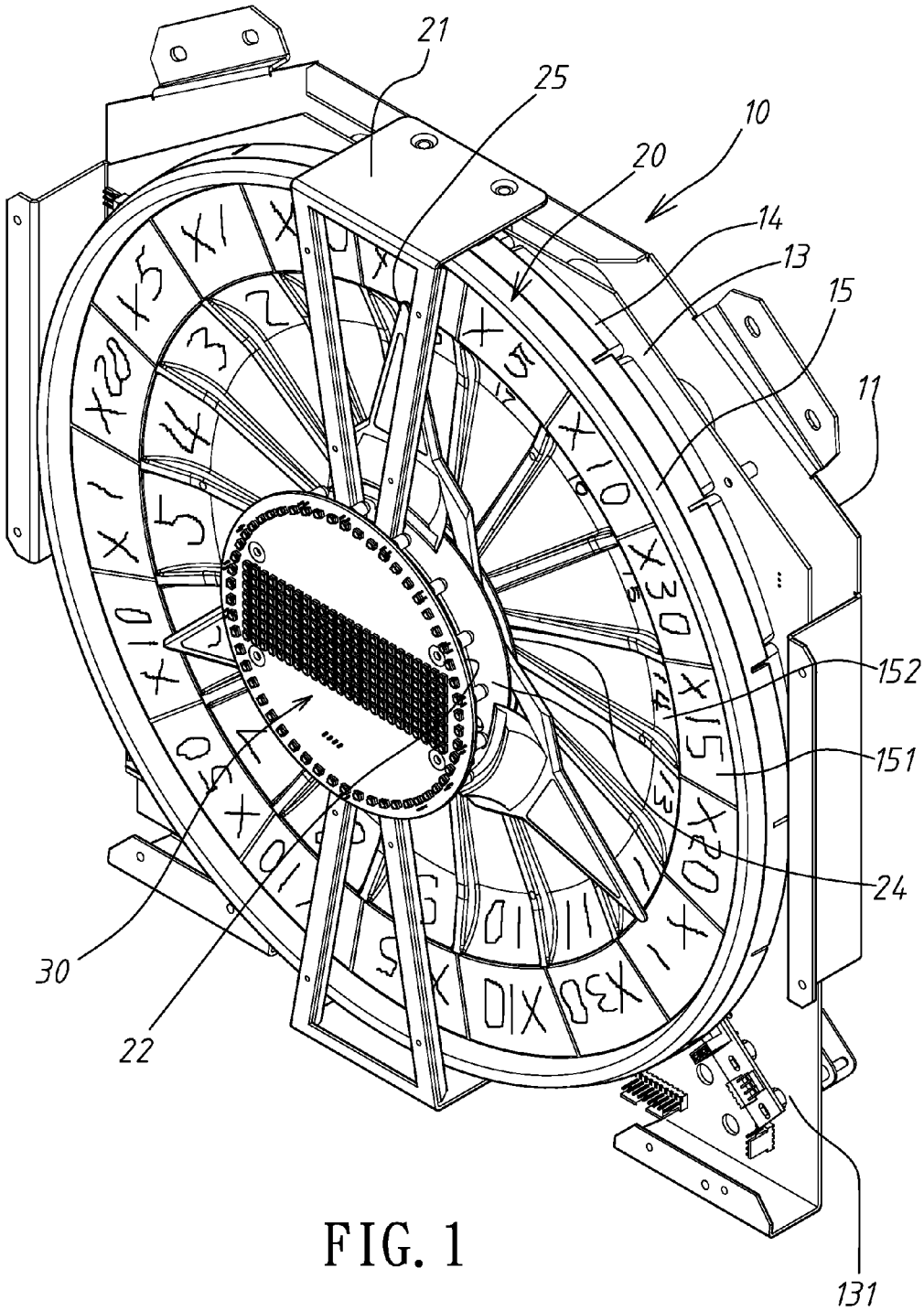
FIG. 1 is a perspective view showing the appearance of the present invention.
Figure 2:
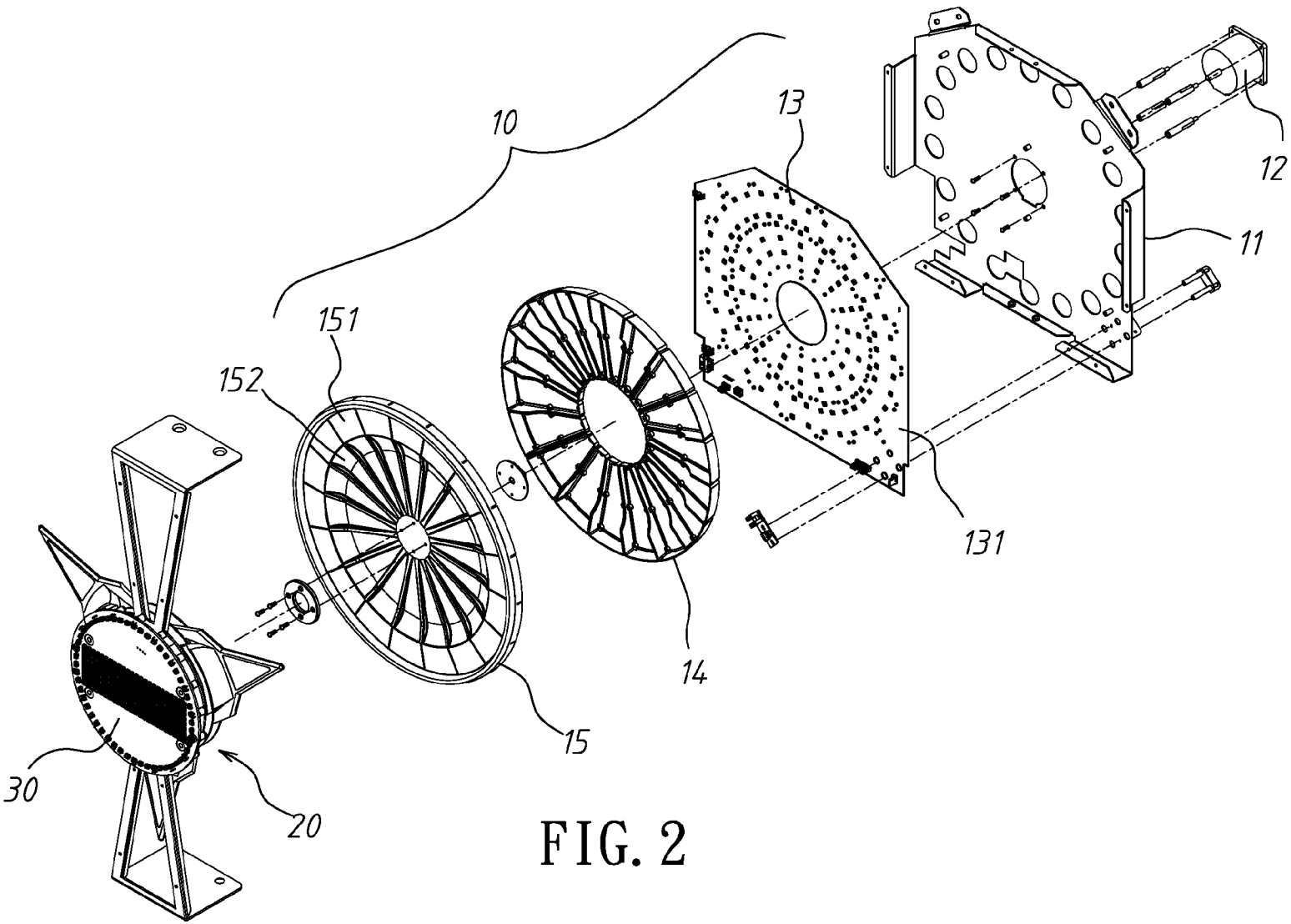
FIG. 2 is an analytic perspective view of a rotary-table device of the present invention.

Referring to FIG. 2, the rotary-table device 10 has an iron rack 11 having at its center a fixed first motor 12 and being provided sequentially on its front side with a main control board 13, a radial partition 14 and a rotary table 15. The rotary table 15 is linked with the first motor 12 and can be driven for rotating; it has at its periphery multiple division areas 151. Each division area 151 has on its surface a color, multiple or figure different from that of any of the other division areas 151, an inner division area 152 inside of each division area 151 can be marked with a number. The main control board 13 has on its lower area a sensing plate 131 to sense the division areas 151 that all index pins 25 (to be described below) stop at.

Figure 3:
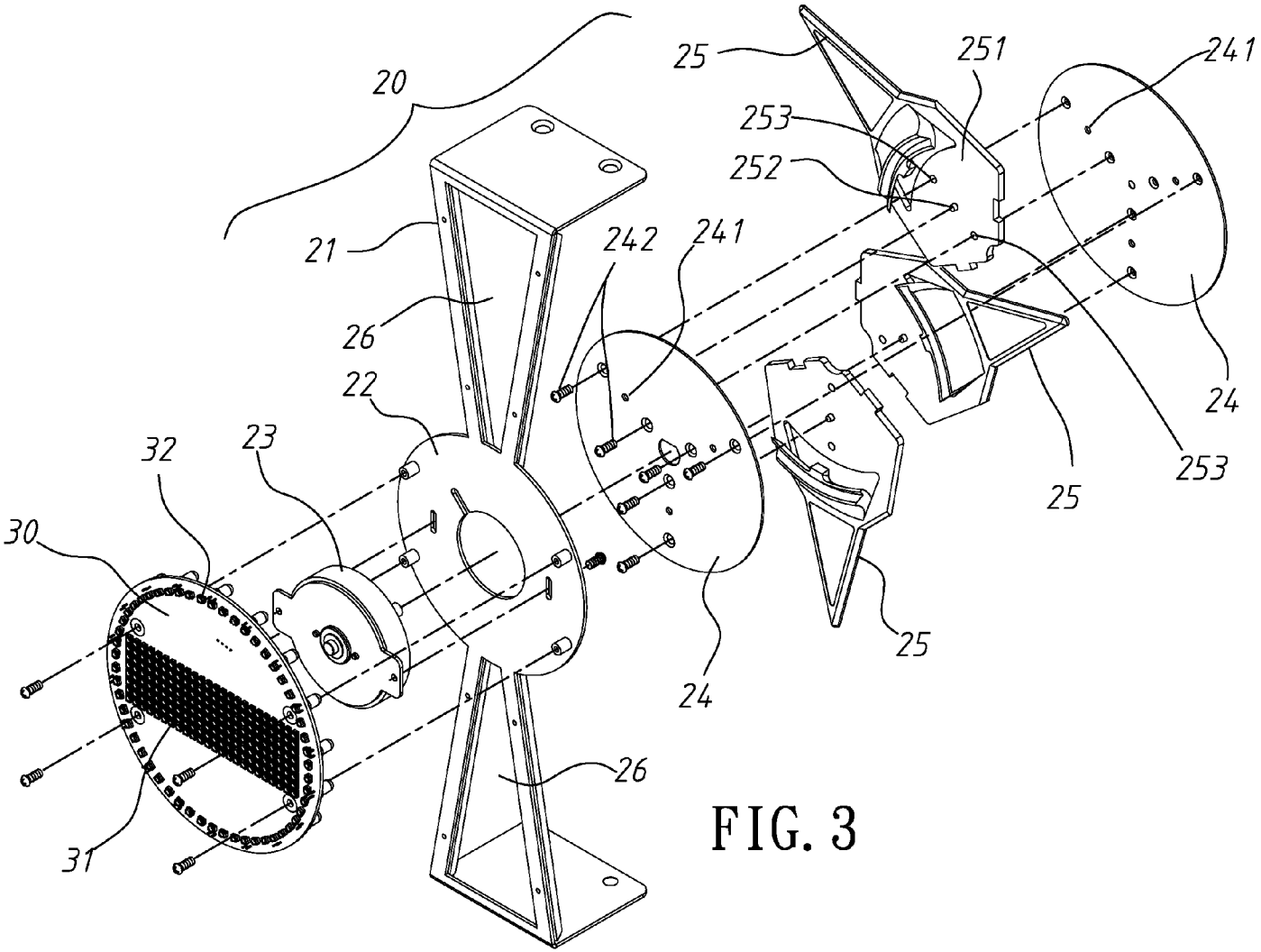
FIG. 3 is an analytic perspective view of an index device of the present invention.

Referring to FIG. 3, the index device 20 has a supporting bracket 21 straddling two ends of the iron rack 11, the supporting bracket 21 has a round plate 22 at its center to fix a second motor 23, and has on the rear thereof an index mechanism that can be rotated by linking up with the second motor 23; the index mechanism has a pair of round clamping plates 24 providing therebetween three index pins 25 arranged to space equiangularly. The supporting bracket 21 of the index device 20 has thereon two trapezoidal holes 26 formed on two mutual opposite sides of the central round plate 22. The number of the index pins 25 is not limited to three, it can be plurality.

Figure 4:
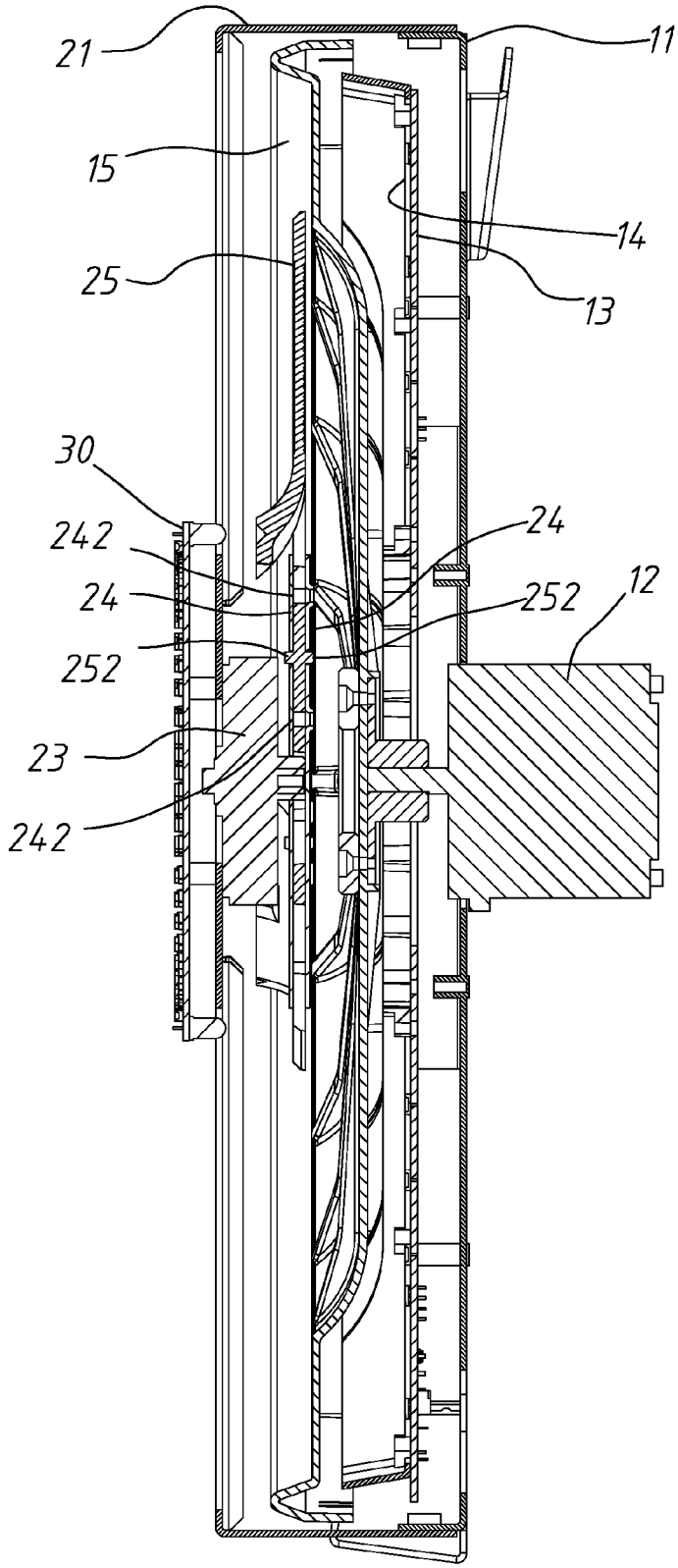
FIG. 4 is a sectional view of the present invention.

The index pins 25 each has a protrusion 252 protruding out of the front and the rear surfaces of a connecting portion 251 that is connected with the round clamping plate 24, and each has two round holes 253 located at two sides of the protrusion 252. Each of the protrusions 252 is engaged in two through holes 241 provided respectively on the two round clamping plates 24, and two screws 242 are extended through the two through holes 241 and the two round holes 253 to lock tight the corresponding one of the index pins 25; thereby the two round clamping plates 24 clamp the three index pins 25, as is shown in FIG. 4.

The display 30 is provided at the outside of the central round plate 22 of the supporting bracket 21 of the index device 20 for showing records. The display 30 is provided at its center with a light emitting diode displaying plate 31 for showing the records, and is provided on its front surface with a peripheral circle of light emitting diodes 32.

In operation of the present invention, the first motor 12 and the second motor 23 make the rotary table 15 rotate reversely against the index mechanism; when in stopping rotation, the three index pins 25 exactly point three different division areas 151 at the periphery of the rotary table 15. By providing the main control board 13 and the sensing plate 131, a result detected is shown on the display 30.

With the rotary-table game machine of the present invention, a player can guess the colors, numbers or figures of the areas where the three index pins 25 point when the latter stop rotating relatively to the rotary table 15, and scores can be calculated according to the multiples marked and shown on the light emitting diode displaying plate 31 of the display 30. By virtue that three marks will be pointed by the three index pins 25 in each time of playing, the player can have multiple ways of guessing. And by virtue that there are the three index pins 25 in the present invention, the odds of winning are increased, and fun of playing can be increased too.

In conclusion, the rotary-table game machine provided in the present invention improves the way of playing as compared with the conventional rotary-table game machine, thus fun of playing can be increased; this can attract more players.

Having now particularly described and ascertained the novelty and improvement of my invention and in what manner the same is to be performed, what I claim will be declared in the claims followed.

The invention claimed is:

1. A rotary-table game machine comprising:

a rotary-table device with an iron rack having at its center a fixed first motor and being provided sequentially on its front side with a main control board, a radial partition and a rotary table; said main control board having on its lower area a sensing plate; said rotary table being linked with said first motor and thus is driven for rotating, and having at its periphery multiple division areas;

an index device having a supporting bracket straddling two ends of said iron rack; said supporting bracket having a round plate at its center to fix a second motor, and having on rear of it an index mechanism that is rotated by linking up with said second motor; said index mechanism has a plurality of index pins arranged in a radiation mode from its center and arranged to space equiangularly; and a display provided at an outside of said round plate of said supporting bracket of said index device for showing records;

in operation, said first motor and said second motor make said rotary table rotate reversely against said index mechanism; when in stopping rotation, said index pins exactly point three different division areas at a periphery of said rotary table; by providing said main control board and said sensing plate, a result detected is shown on said display.

2. The rotary-table game machine as defined in claim 1, wherein: said index mechanism further has a pair of round clamping plates for clamping said index pins.

3. The rotary-table game machine as defined in claim 1, wherein said supporting bracket of said index device has thereon two trapezoidal holes formed on two mutual opposite sides of said round plate at said center.

4. The rotary-table game machine as defined in claim 1, wherein said display is provided with a light emitting diode displaying plate for showing records.

5. The rotary-table game machine as defined in claim 4, wherein said display is provided on its front surface with a peripheral circle of light emitting diodes.

6. The rotary-table game machine as defined in claim 1, wherein said rotary-table device has at its periphery multiple division areas, each of said division areas has on its surface a color different from that of any of others of said division areas.

7. The rotary-table game machine as defined in claim 1, wherein said rotary-table device has at its periphery multiple division areas, each of said division areas has on its surface a multiple different from that of any of others of said division areas.

8. The rotary-table game machine as defined in claim 1, wherein said rotary-table device has at its periphery multiple division areas, each of said division areas has on its surface a figure different from that of any of others of said division areas.

* * * * *